United States Patent [19]

Brais

[11] Patent Number: 4,977,933

[45] Date of Patent: Dec. 18, 1990

[54] CIRCULAR LOOM FOR WEAVING RIBBON-SHAPED MATERIALS

[75] Inventor: Joseph E. Brais, Warwick, R.I.

[73] Assignee: Joss Company, Carolina, R.I.

[21] Appl. No.: 314,232

[22] Filed: Feb. 21, 1989

Related U.S. Application Data

[63] Continuation of Ser. No. 738,461, May 28, 1985, abandoned, which is a substitute for Ser. No. 390,856, Aug. 23, 1973, abandoned, which is a continuation of Ser. No. 172,863, Aug. 18, 1971, abandoned.

[51] Int. Cl.[5] ..... D03D 37/00

[52] U.S. Cl. ..... 139/459; 139/15

[58] Field of Search ..... 139/457–459, 139/14, 15, 16, 436

[56] References Cited

U.S. PATENT DOCUMENTS

| | | | |
|---|---|---|---|
| 338,620 | 5/1943 | Pelee | 139/15 |
| 702,281 | 6/1902 | Brown . | |
| 874,678 | 12/1907 | Harris . | |
| 903,146 | 11/1908 | Withee et al. | 139/304 |
| 1,109,250 | 9/1914 | Royle . | |
| 1,139,073 | 5/1915 | Rhomoser . | |
| 1,418,239 | 5/1922 | Crespi . | |
| 1,495,311 | 5/1924 | Stuer . | |
| 1,694,254 | 12/1928 | Frederickson . | |
| 2,080,771 | 5/1937 | Hale . | |
| 2,080,775 | 5/1937 | Jabouley et al. . | |
| 2,101,023 | 12/1937 | Hale et al. . | |
| 2,168,358 | 8/1939 | Baumgarten . | |
| 2,433,479 | 12/1947 | Pelee | 139/13 R |
| 2,454,146 | 11/1948 | Ezbelent . | |
| 2,487,148 | 11/1949 | Latieule et al. . | |
| 2,506,442 | 5/1950 | Cooper . | |
| 2,603,240 | 7/1952 | Christiansen et al. . | |
| 2,609,838 | 9/1952 | Cole . | |
| 2,696,837 | 12/1954 | Christiansen et al. . | |
| 2,737,207 | 3/1956 | Lariuere | 139/13 R |
| 2,869,586 | 1/1959 | Jasienski . | |
| 2,893,439 | 7/1959 | Rabeux et al. . | |
| 2,976,890 | 3/1961 | Rabeux et al. . | |
| 3,342,219 | 9/1967 | Malchair . | |
| 3,669,157 | 6/1972 | Woodall, Jr. et al. | 139/387 R |
| 3,719,210 | 3/1973 | Emerson et al. | 139/13 R |
| 3,730,230 | 5/1973 | Kodis | 139/304 |
| 3,871,413 | 3/1975 | Torii . | |
| 4,290,209 | 9/1981 | Buchanan et al. | 139/383 A |
| 4,365,651 | 12/1982 | Torii | 139/13 A |

FOREIGN PATENT DOCUMENTS

| | | | |
|---|---|---|---|
| 358440 | 12/1972 | U.S.S.R. | 139/15 |

*Primary Examiner*—Harvey C. Hornsby
*Assistant Examiner*—Joseph S. Machuga
*Attorney, Agent, or Firm*—Fleit, Jacobson, Cohn, Price, Holman & Stern

[57] ABSTRACT

A circular loom for making fabric, especially from flat strip-like or ribbon-shaped material, in which the weft carrier or shuttle assembly travels in a circular path and has a body member carrying its own weft supply, motive power means and warp shed forming means. A cam mechanism automatically orients the entering warp ends in advance of the carrier or shuttle assembly to a position for weaving the desired fabric pattern.

59 Claims, 7 Drawing Sheets

FIG. 8
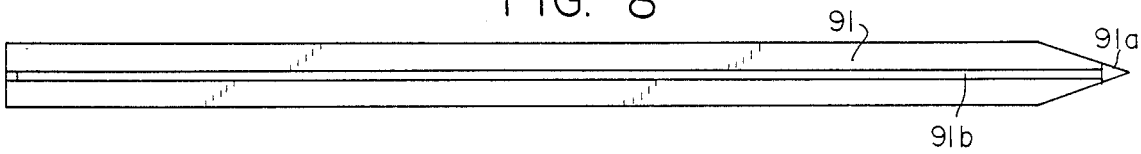
FIG. 9
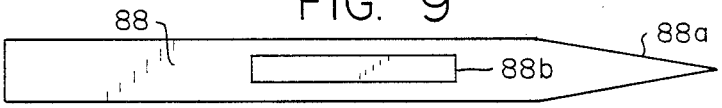
FIG. 10
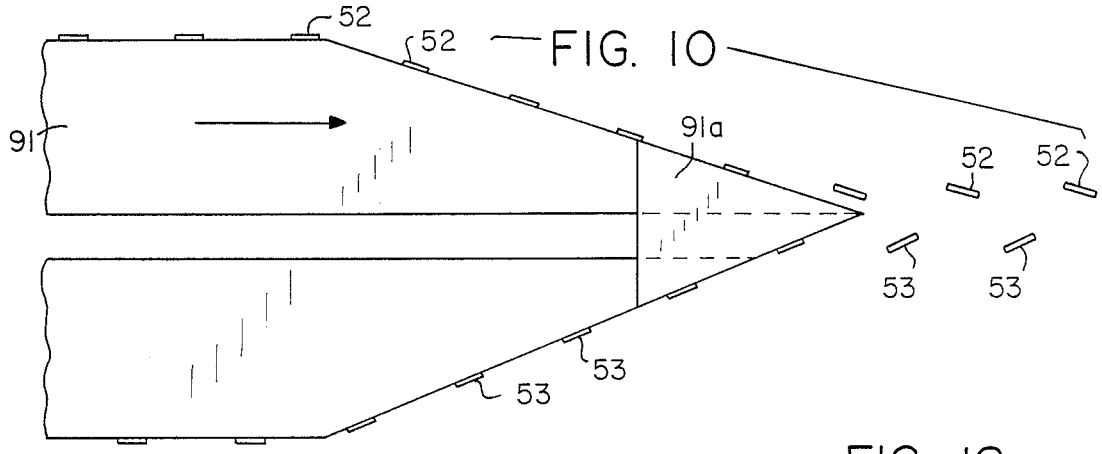
FIG. 11
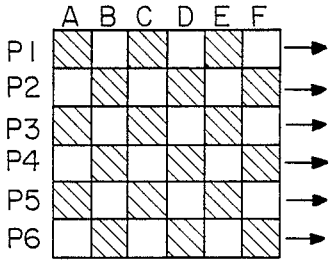
FIG. 13
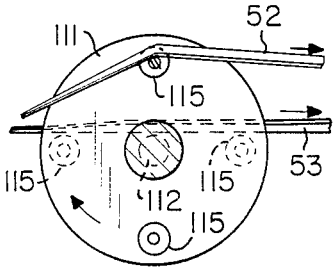
FIG. 12
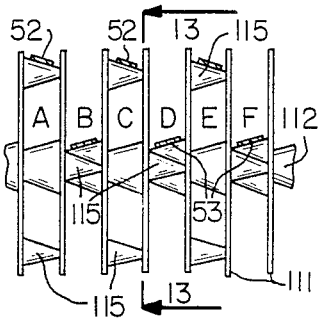
FIG. 14
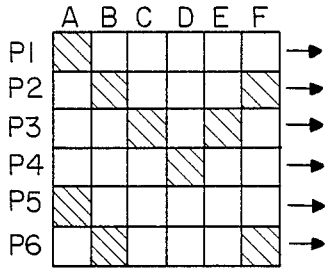
FIG. 16
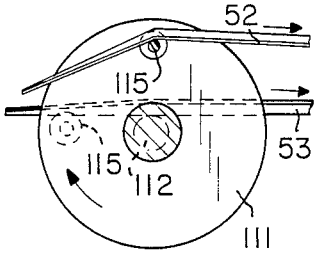
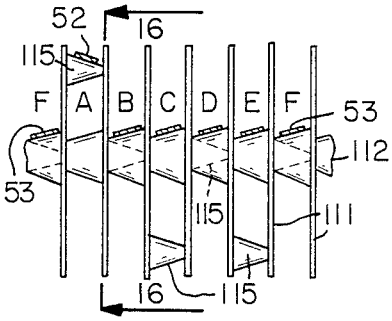
FIG. 15
FIG. 25
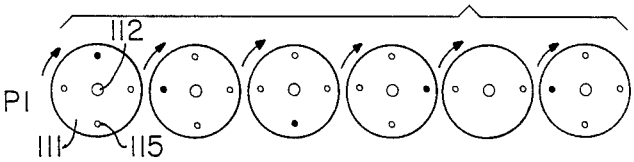

CIRCULAR LOOM FOR WEAVING RIBBON-SHAPED MATERIALS

This application is a continuation of application Ser. No. 06/738,461, filed May 28, 1985, now abandoned, which is a substitute application for application Ser. No. 390,856, filed Aug. 23, 1973, which was expressly abandoned without abandoning the invention, and which was a continuation of application Ser. No. 172,863, filed Aug. 18, 1971, now abandoned.

BACKGROUND OF THE INVENTION

1. Field of the Invention

This invention relates to looms and, in particular, circular looms for weaving flat strip-like or ribbon-shaped materials into fabric. In addition, this invention relates to weft carriers or shuttle assemblies and mechanisms for orienting warp ends in preparation for formation of a warp shed in circular looms, to methods for making fabric, particularly from ribbon-shaped materials, and to the unique fabric resulting therefrom. For the purpose of this invention, the term "ribbon-shaped" as applied to the thread or material from which fabric is woven in accordance with the structure and methods of this invention includes not only what is normally accepted as a ribbon or strip shape but also any continuous non-cylindrical shape. Further, the type materials acceptable for this invention include any flexible material including thread, plastics, thin metal strips, imitation leathers, etc.

2. Description of The Prior Art

While it is evident that vibration and noise can be considerably reduced, and the speed of weaving greatly increased, by the use of looms in which the shuttle travels in a circular path, such looms have not replaced the frame-type looms which use a reciprocating shuttle motion for all purposes. The main reasons for this is that circular looms have been unable to produce the consistently high-quality fabric made with frame-type looms. As such, to date the circular loom has been employed only for certain specialized fabrics, such as fire hose and the like.

The inferior quality of fabrics produced with existing looms, whether of the frame or circular type, is especially pronounced in the case of fabrics woven from ribbon-shaped thread. The first defect in such fabric is the undue twist which is generally imparted to weft ribbon as it slips off the end of a weft spool. The twist is carried into the fabric and results in irregular surface characteristics, giving rise to unsightly appearance and a poorly wearing fabric. A second defect is the undue crush or flattening imparted to ribbon-type thread as it is woven into fabric, caused by the combs conventionally employed in looms to press and maintain the ribbon-type threads in the fabric during the weaving process. A third fault, normally referred to as irregular face, is caused primarily by reversal of the faces of the weft and/or ribbon-shaped threads during weaving. This defect is especially evident when the two faces of the weft and/or warp thread differ in construction, color or quality.

Accordingly, existing weaving machines, whether of the frame or circular type, are deficient especially when it is desired to manufacture fabric from ribbon-shaped stock. In addition, the known circular looms are limited in their capabilities both as to types and quality of fabric produced. For example, while some circular looms can produce a heavy fabric such as fire hose, they are unable to produce wide fabrics or finer weaving patterns such as herringbone, twill, basket and sateen.

Moreover, even when the quality of the specialized fabrics produced by known circular looms is good, such looms are limited in weaving speed and in the size or width of the fabric which they can produce. One reason for this is that such looms have relied upon motive power, driving mechanisms and warp-end oriented mechanisms, which are slow, expensive, cumbersome and poorly timed.

OBJECTS AND SUMMARY OF THE INVENTION

Accordingly, the principal object of my invention is to provide a loom whose design, structure and operation overcome the problems of twist, crush and irregular face in weaving ribbon-shaped materials.

Another object of my invention is to provide a new and improved circular loom which can be set for weaving a wide variety of fabric patterns into high-quality fabrics from ribbon-shaped materials as well as yarn threads.

A further object of my invention is to provide a new and improved circular loom design which can accommodate more than one rotating shuttle assembly.

A still further object of my invention is to provide a new and improved shuttle assembly for a circular loom.

Another object is to provide a new and improved mechanism for orienting the warp ends in preparation for formation of a warp shed.

Still another object of my invention is to provide a new and improved circular loom which is capable of high-speed weaving of a wide variety of fabric patterns into high-quality fabric from yarn or ribbon-shaped threads.

An additional object of the invention is to provide new and improved methods for weaving fabric wherein the speed of weaving, the width of cloth produced and the quality of the product are enhanced.

These and other objects, features and advantages of my invention will be apparent to those skilled in the art from the more detailed description hereinafter.

In summary outline, the weft carrier or shuttle assembly of the present invention travels in a circular path about the table of a loom. A primary feature of this carrier or shuttle assembly is the use of a body member which carries its own weft supply, motive power means and warp shed forming means. The mechanism for orienting the entering warp ends in advance of the warp shed forming means comprises either a plurality of sets of disks mounted outside the path of the shuttle assembly in which each set of disks rotates together on a common axis in spaced-apart relationship and receives the entering warp ends therebetween or, alternatively, a rotating finger-like member carried on the shuttle assembly, which has a off-center point. In either form of the orienting mechanism of this invention, the entering warp ends are selectively positioned upwardly or downwardly in advance of contact with the warp shed forming means of the shuttle assembly, and suitable means are provided to reset the orienting mechanism in timed relationship to the passage of the shuttle assembly.

In the preferred form of the orienting mechanism comprising the sets of disks, it is possible to reset the orienting mechanism immediately after the shuttle assembly has entered the warp shed such that the entering warp ends are automatically reoriented before the complete pass of the shuttle assembly. As such, the circular loom of the instant invention incorporating the foregoing shuttle assembly and warp end orienting mechanism is capable of better orienting the warp ends, particularly for ribbon-shaped materials, and allows significantly increased speeds and operation.

In the weaving method of the instant invention, the weft carrier or shuttle assembly travels in a circular path about the table of the loom through the warp ends entering the loom, which warp ends have been oriented in advance of the shuttle assembly. Upon passing through the entering warp ends, the shuttle assembly separates the warp ends to form a warp shed, and, simultaneously, weft from the weft supply carried by the carrier or shuttle assembly is guided to the fabric forming plane to which the warp ends converge from the warp shed, whereby fabric is formed. In the preferred form of the invention, at the same time that the shuttle assembly is passing through the warp shed, the entering warp ends are selectively reoriented in preparation for a subsequent pass of a shuttle assembly. And the fabric is taken up as it is formed.

The invention accordingly comprises the several steps and the relationship of one or more such steps with respect to each of the others in a method for forming fabric together with an apparatus embodying features of construction, combinations of elements and arrangements of parts which are adapted to effect such steps and the product resulting therefrom, all as exemplified in the following detailed disclosure.

BRIEF DESCRIPTION OF THE DRAWINGS

For a more complete understanding of the nature and objects of the invention, reference is had to the following description taken in conjunction with the accompanying drawings, in which:

FIG. 8 is a side view of a first pointed member of the warp shed forming means of the invention, somewhat reduced in size from the view of FIG. 7 and FIG. 3;

FIG. 9 is a side view of a second pointed member of the warp shed forming means of the invention, somewhat reduced in size from the view of this member in FIG. 3;

FIG. 10 is an enlarged side view of the forward portion of the pointed member of FIG. 8, together with entering warp ends shown in section;

FIG. 11 is a diagram of a plain weave pattern provided by the invention;

FIG. 12 is a side view of a portion of the preferred mechanism for orienting warp ends to produce the plain weave pattern of FIG. 11;

FIG. 13 is a section view taken along line 13—13 of FIG. 12;

FIG. 14 is a diagram of a herringbone pattern provided by the invention;

FIG. 15 is a side view of a portion of the preferred mechanism for orienting warp ends in another arrangement from FIG. 12 to produce the herringbone pattern of FIG. 14;

FIG. 16 is a sectional view taken along line 16—16 of FIG. 15;

FIG. 25 is an exploded view of the disks of FIG. 15.

DETAILED DESCRIPTION OF SPECIFIC EMBODIMENTS

For ease of understanding, the following description is organized under separate headings but it should be understood that such headings do not necessarily place limitations on the spirit and scope of the invention. Moreover, although the loom of the invention is termed a "circular loom", because the shuttle assembly of the loom travels in a circular path on the table of the loom, it will be realized that the general appearance of the loom, other than the immediate portion upon which the shuttle assembly travels, need not be circular. Accordingly, the term "circular loom" is merely a convenience and likewise is not a necessary limitation upon the spirit or scope of the invention.

Supporting Structure

Figure 2:
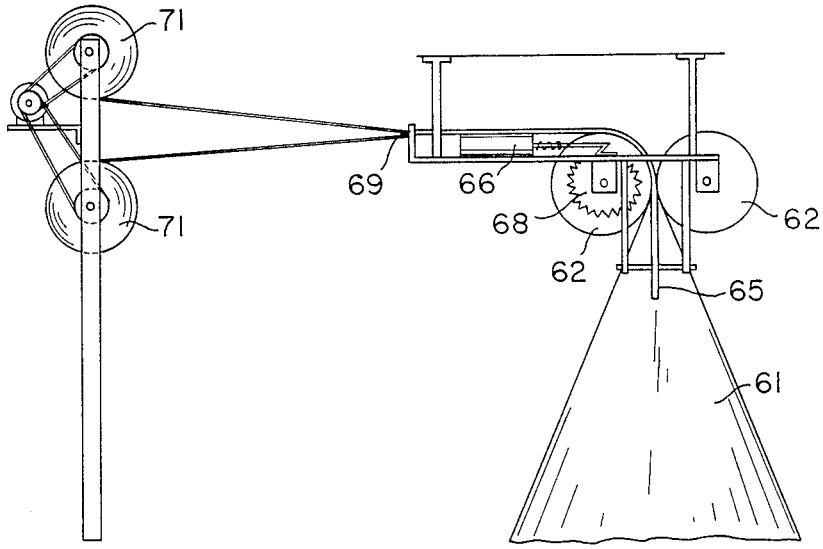
FIG. 2 is an enlarged side view taken in the direction of arrow 2 in FIG. 1.
Figure 3:
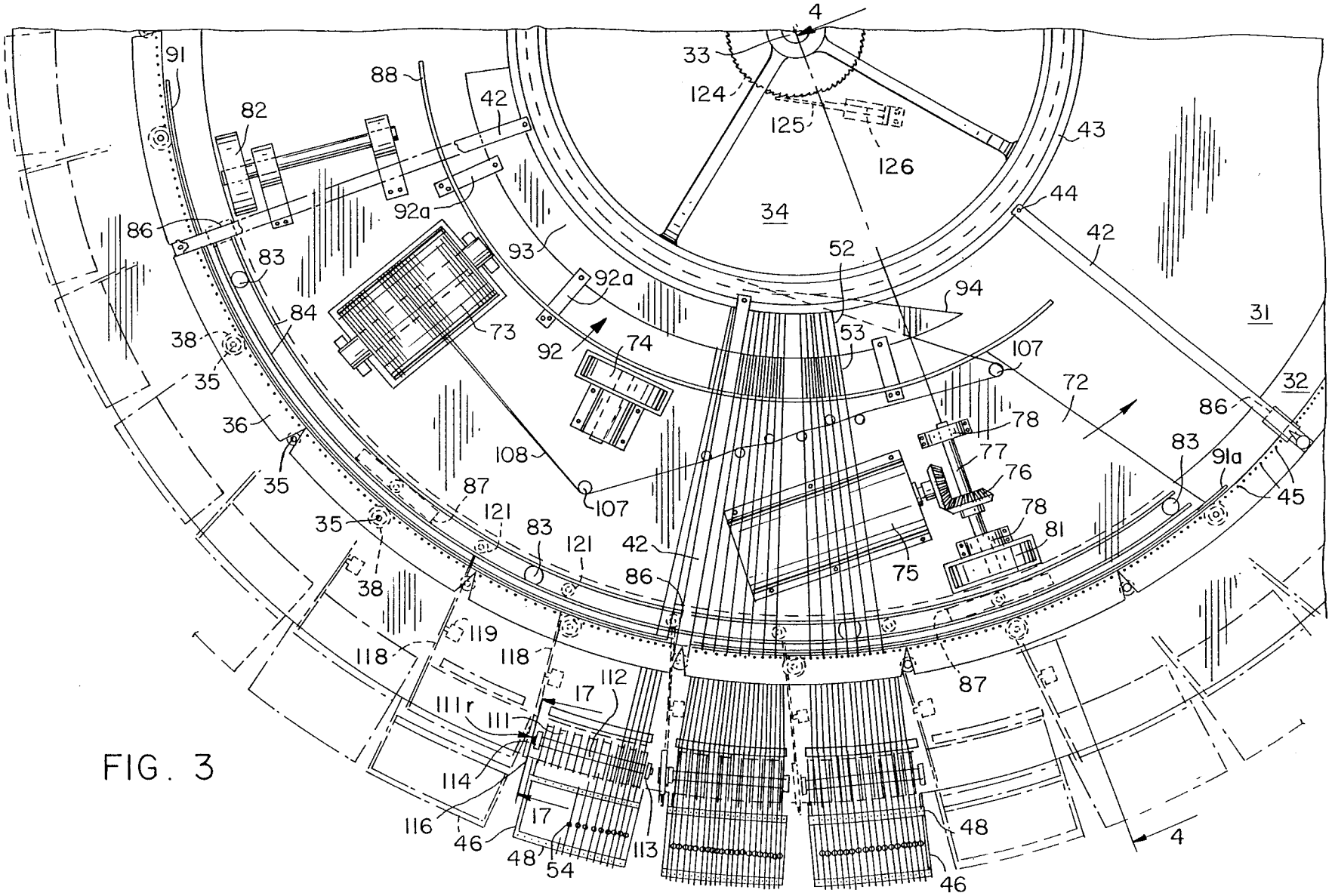
FIG. 3 is a combined enlarged sectional view taken along line 3—3 of FIG. 1 and a partial top plan view of the loom of the instant invention showing the preferred form of the mechanism for orienting the entering warp ends.
Figures 4, 5, 22:
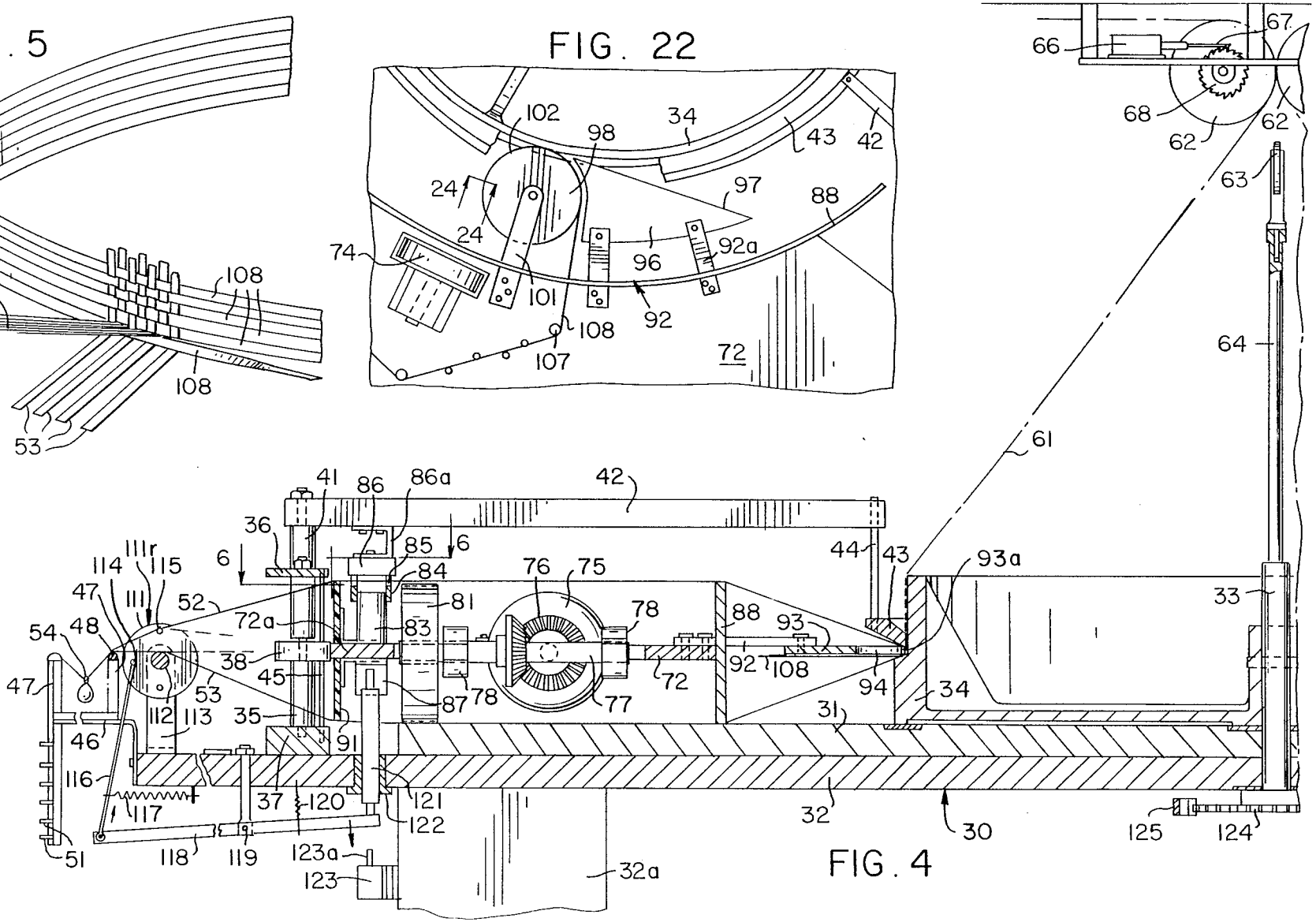
FIG. 4 is a sectional view of a portion of a loom of the invention taken along line 4—4 of FIG. 3.
FIG. 5 is a perspective view of a portion of the fabric as it is being woven in accordance with the invention.
FIG. 22 is a top plan view of a modification of the weft-guiding and shuttle positioning means assembly of this invention.
Figure 6:
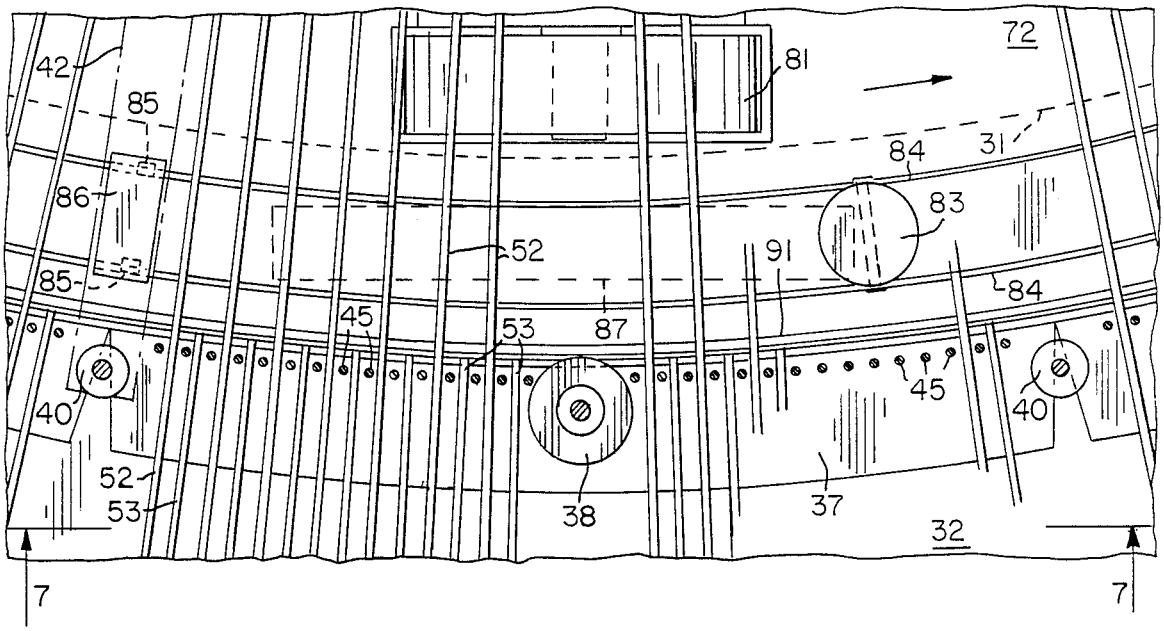
FIG. 6 is an enlarged, partial sectional view taken along line 6—6 of FIG. 4.
Figure 7:
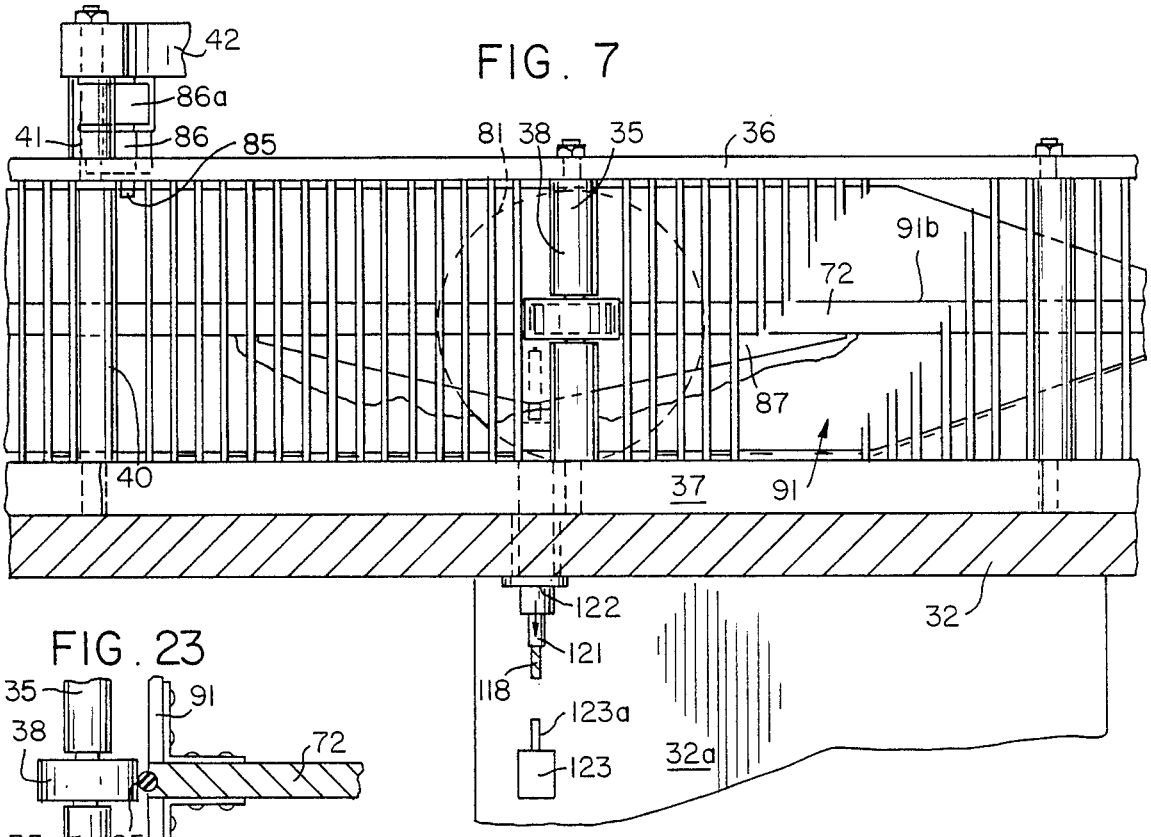
FIG. 7 is a partial, enlarged sectional view taken along line 7—7 of FIG. 6.

FIGS. 1-4, 6 and 7 illustrate the basic supporting structure of the loom of this invention. With particular reference to FIG. 4, it will be noted that the basic supporting structure includes a horizontally disposed table 30, preferably circular and having an upper component 31, a lower component 32 and support columns **32*a*. A central shaft 33 is mounted by the table and is capable of rotating a fabric forming member or surface, preferably in the form of a hollow column or drum 34, if desired. The shaft 33 and drum 34 are preferably rotatable in timed relationship to the rate of weaving (or the speed of the shuttle assembly or assemblies in weaving the fabric), if it is desired to rotate drum 34** during the weaving operation.

The shaft 33 is at the center of a circle generally defined by a segmented ring 36 spaced above table 30. Secured between the table 30 and the ring 36 and assisting in the support of ring 36 are a plurality of posts 35. The posts 35 may be mounted on a lower ring 37 as shown in FIG. 4. Each post 35 has a centrally disposed roller 38, which exerts a centripetal force on the shuttle assembly as it rotates in its circular path on the loom. Dispersed among the posts 35 are a series of more elevated posts having a lower portion 40 (see FIG. 3), which also assist in supporting upper ring 36, and an upper portion 41 extending above ring 36 to support a plurality of bridging members 42. The bridging members 42 support means, such as a ring 43, for guiding warp to contact with weft in a fabric forming plane against the side of drum 34. Guide ring 43 is suspended from bridging member 42 by a depending rod 44.

Mounted between upper ring 36 and lower ring 37, inside the circle formed by posts 35, are a plurality of means for horizontally spacing the warp ends entering the loom, such as separator or guide rods 45. Mounted outwardly of the circle defined by posts 35, on the lower component 32 of the table 30, are brackets 46, which support, through legs 47, a pair of circular rails 48. The lower portion or the outermost side of legs 47 is provided with friction pins 51, through which warp ends 52 and 53 pass, to take up slack on the entering warp ends 52 and 53. A weight 54 also hangs loosely on each entering warp end between the pair of rails 48 to assist in controlling the slack of the warp ends. The loom may be equipped with equivalent slack take-up or tensioning devices such as spring mechanisms or the like.

Completing the basic supporting structure of the loom is a creel assembly 55 (FIG. 1) for supporting warp supply rolls 56. The creel assembly 55 and warp rolls 56 may be positioned in any manner convenient for supply of warp ends 52 and 53 to the loom. In order to weave an even fabric with complete continuity of pattern it is necessary to have an uneven number of warp ends simultaneously entering the loom. As shown, the warp ends 52 and 53 pass from the supply rolls 56 to below the floor supporting the loom in order to give access to other components of the loom, but the creel assembly 55 may also be positioned adjacent the circular rails 48 and downwardly of the table 30 of the loom if desired.

Fabric Take-up Assembly

Figure 1:
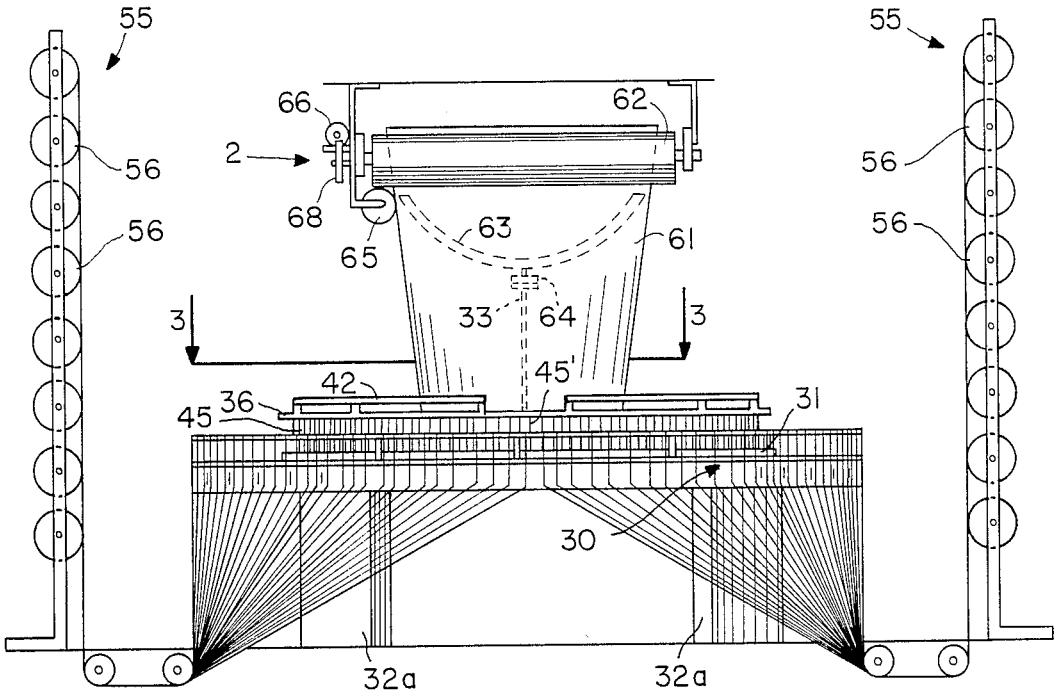
FIG. 1 is a schematic side elevational view of a circular loom of the instant invention.

With reference to FIGS. 1, 2 and 4, the fabric as it is woven by the loom forms a tube or column 61 which is collapsed or pinched together at the upper end to form a dual layer of fabric. The fabric is then pulled upwardly by and through pull rolls 62. Spreader bar 63' is rotatably mounted at the end of shaft 33 through swivel 64 so that if it is desired to rotate shaft 33 and drum 34 then spreader bar 63 may remain stationary. Spreader bar 63 is curved to impinge upon and spread the column of fabric at its upper end as it is pulled upwardly in order to form the dual layer engaged by pull rolls 62. If it is desired to form a single fabric layer from the flattened dual layer of fabric, it will be useful to first apply edging to one edge of the dual layer fabric, as by a tape roll 65. One or both of pull rolls 62 may be actuated by a solenoid 66 which operates a pawl and ratchet reel 68 in timed sequence to the speed of the shuttle assembly as the fabric is woven. As the dual layer of fabric, with one edge taped if desired, passes out of roll 62, one or both edges may be slit by one or more knife edges 69 so as to form a single layer of fabric or two separate layers of fabric. The fabric is then wound on take up rolls 71 operated by a motor and pulley assembly, also actuated in timed relationship to pull rolls 62 and the rate of weaving, in a manner explained below.

Shuttle Assembly

Figure 26:
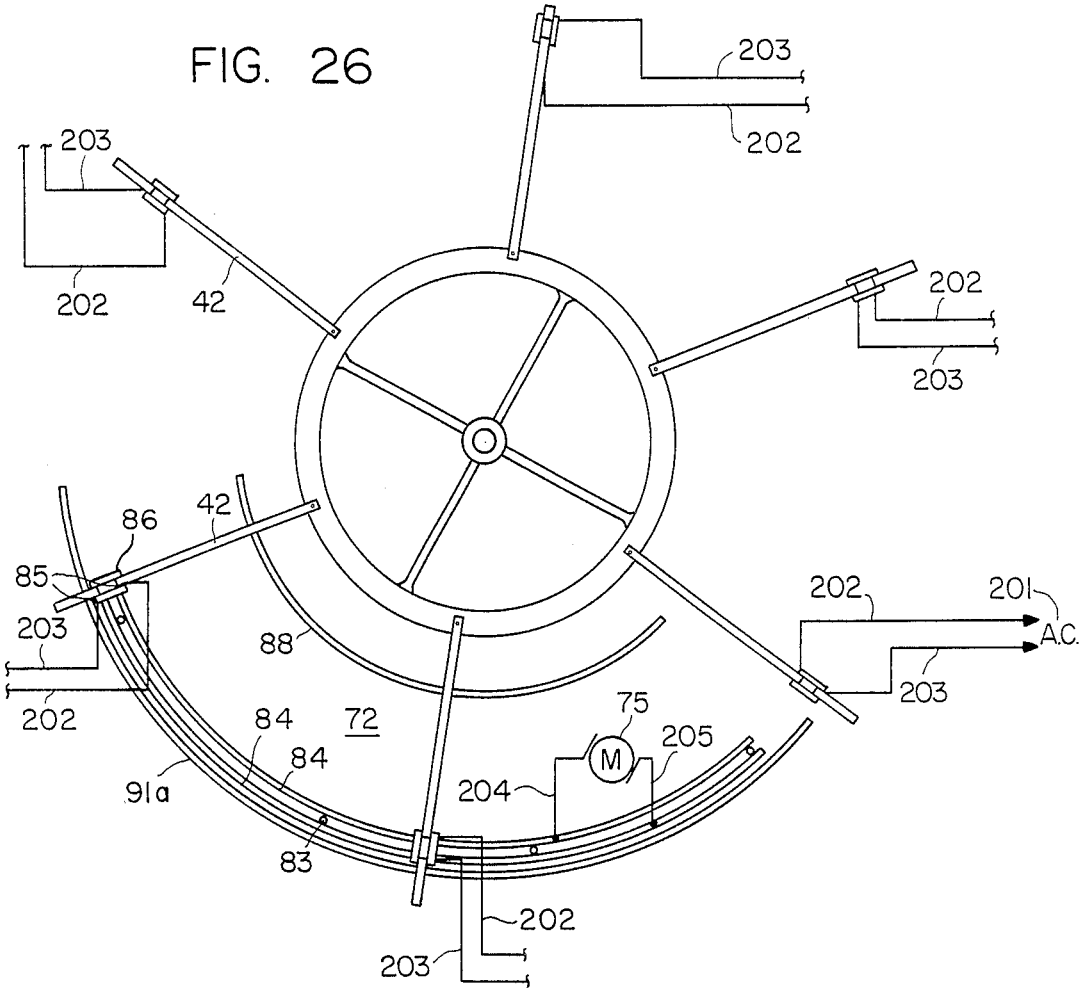
FIG. 26 is a schematic view of the electrical circuitry by which electrical power is transmitted to the motor of the weft carrier or shuttle assembly.

With reference to FIGS. 3–10, the weft carrier or shuttle assembly of this invention includes a body member such as horizontal plate 72 shaped to facilitate movement in a circular path about the upper component 31 of the table 30 of the loom. The plate 72 carries in a cutout a weft supply such as one or more spools or reels 73, and in a similar cutout, motive power means such as an electric motor 75. Drive means from the motor include bevel gears 76, a shaft 77, a bearing 78 on the shaft, and a drive wheel 81 set in another cutout in plate 72. The drive wheel 81 is in frictional contact with the upper component 31 of the table 30 of the loom and rides over the warp ends 53 during its circular travel. Idler wheels, such as additional wheels 74 and 82, are provided to maintain the assembly moving freely. Mounted on plate 72 outwardly of drive wheel 81 is a plurality of "standoff" columns or bars 83 supporting a pair of commutator slip ring segments 84. The standoff columns 83 are electrically insulated. The slip ring segments 84 provide electrical contact with a pair of brushes 85 carried on brush supports 86 suspended by bracket **86*a* from each of bridging members 42. The brushes 85 and, of course, the bridging members 42 are positioned such that at all times at least one pair of brushes is in contact with segments 84 of the shuttle assembly. The brushes 85 are preferably spaced 60° apart around the circular path of the loom and, therefore, the arc of the slip ring segments 84 must cover an arc of at least approximately 70°. Electrical energy is continuously supplied from a suitable source such as A.C. power source 201 (see FIG. 26) to each stationary brush 85 through wire connections 202 and 203. The slip ring segments 84 are in turn electrically connected to motor 75 by wiring 204 and 205. Therefore, by means of the aforesaid continuous contact of the brushes 85 with the slip ring segments 84, continuous electrical energy is supplied to motor 75**.

Below the plane of plate 72 are one or more cams, preferably two, in the form of rising blocks or surfaces 87 which serve to trigger the warp end orienting mechanism to reorient the warp ends 52 and 53 for the next pass of a shuttle assembly, as explained more fully hereinafter.

Figure 23:
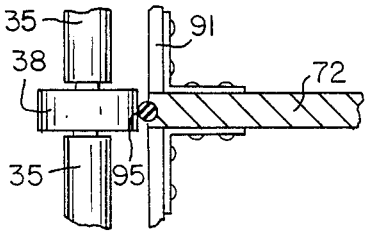
FIG. 23 is an enlarged side view, partially in section, of another modification of a portion of FIG. 4.

Mounted vertically on the inner edge of the plate 72 is a pointed member or "face," preferably in the form of a pointed plate 88 conformed in shape (or curved) to the plate 72, having a tip **88*a* (See FIG. 9). A similar pointed member or "face," preferably in the form of a pointed plate 91 having a tip 91*a* and a longitudinal slit 91*b* (See FIG. 8), is mounted on the outer edge 72*a* of the shuttle plate 72. The slit 91*b* permits insertion therethrough of the outer edge 72*a* for contact of the edge with rollers 38. The outer edge of the plate 72 may be preferably designed with a bead 95 (see FIG. 23) made of a resilient material, such as natural or synthetic rubber, to provide low friction contact of the shuttle assembly plate 72 against the rollers 38** and to absorb the centrifugal force exerted by the shuttle against the rollers.

While metal is preferred in a construction of pointed plates 88 and 91, a heavy-duty plastic or other material may also be suitable. The pointed members 88 and 91 may be shaped otherwise than as plates. For example, they may be tubular, conical, or have any other form suitable for separating the warp ends 52 and 53 to form a warp shed as the shuttle circles the loom. Also, a single such pointed member may be employed, if it has dimensions (for example, height) sufficient to cause formation of a warp shed.

As best shown in FIGS. 3 and 4, the plate 72 of the shuttle assembly has connected thereto an adjustable assembly 92 for properly positioning the weft carrier or shuttle assembly between drum 34 and wheels 38 during its rotation around the circular path of the loom. This positioning assembly 92 includes adjustable supports 92*a* and a plate-like member 93. The member 93, which may be crescent-shaped or which may comprise a segment of a ring to conform it circumferentially to drum 34, and the tubular fabric as shown in FIG. 3 has an inner edge adapted for tangential sliding contact with fabric as it is formed, and a leading edge 94 angled away from the drum 34. The tangential sliding contact is assured by positioning adjustable supports 92*a* to achieve such contact while edge 72*a* of the plate 72 is in contact with wheels 38. Plate-like member 93 also serves to guide weft 108 from weft supply 73 to contact on the drum 34 with the warp ends 52 and 53 passing from the warp shed formed by pointed members 88 and 91. As shown in FIG. 3, the weft 108 is fed from weft supply 73, around guide pins 107 and underneath plate 93. As is shown in FIGS. 4 and 5, as the weft 108 in the form of a ribbon-shaped thread passes under plate 93, the plane of the weft assumes a generally horizontally disposed position and the weft then is turned around curved inner edge side 93*a* of plate 93 into a vertically disposed position and guided into circumferential contact between the inner edge and the warp ends 52 and 53 (see FIG. 5). Inner edge 93*a* of plate 93, which extends circumferentially of the tubular fabric, may be slightly rounded in order to facilitate this guiding of the weft 108 back into a generally vertical plane into contact with the warp ends 52 and 53 at the fabric forming plane of drum 34.

FIG. 22 illustrates a modified form of the guiding and positioning assembly 92 described above. With reference thereto, a plate-like wedge-shaped member 96, having an inner edge 97 angled away from the surface of drum 34, is connected to plate 72 by adjustable supports 92*a*. Mounted rearwardly of member 96 is an idler guide wheel 98 connected to plate 72 by an adjustable support 101. Idler wheel 98 is positioned by support 101 so that it is in riding contact with drum 34 when edge 72*a* is in contact with rollers 38 on the other side of the carrier or shuttle assembly. The wheel 98 has a channeled rim for guiding the weft 108 to the surface of drum 34. It will be noted that the member 96 is in tangential sliding contact with the fabric, thus forming a path for the laying in of the weft 108. The rim 102 of wheel 98 may have a single channel, or, as shown in FIG. 24, may comprise a plurality of channels to accommodate a plurality of generally cylindrical weft ends 108 to form an array of generally cylindrical shaped threads in a ribbon shape.

Figure 24:
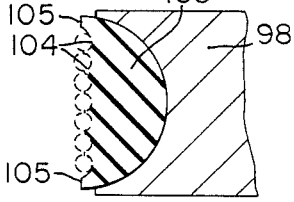
FIG. 24 is an enlarged sectional view taken along line 24—24 of FIG. 22.

With reference to FIG. 24, a circumferential insert 103 for wheel 98 is provided with grooves 104 separated by upstanding edges 105. By using circumferential inserts associated with wheel 103, the edge 102 of wheel 98 can be adapted to support a single weft end 108, such as a ribbon-shaped weft having a substantial width, or a number of narrower weft ends in an array form. Accordingly, the shuttle assembly is adaptable for the weaving of multi strand weft ends 108 as well as single-strand weft ends.

Figure 27:
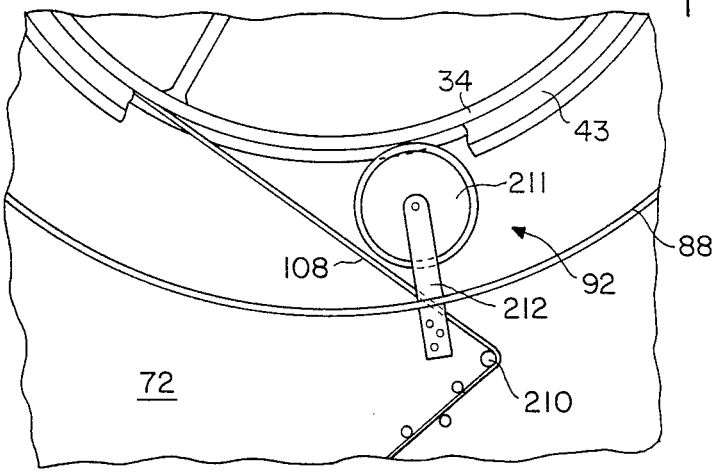
FIG. 27 is a top plan view of a further, but preferred, form of the weft-guiding and shuttle positioning means assembly of this invention.

A further, and the preferred, form of the guiding and positioning assembly 92 for this invention is illustrated in FIG. 27. Weft end 108 from weft supply 73 is led around post 210 and directly to the point of fabric forming on the drum 34 with the warp ends 52 and 53 passing from the warp shed. The weft end 108 assumes a tangential position with respect to the drum 34 and the warp ends 52 and 53 with which it is woven, and no twisting of the weft end occurs as in the embodiment of FIGS. 3 and 4. Traveling in advance of the weft end 108 is a wheel 211 which is mounted by means of adjustable support 212 on the plate 72 and which is in rolling contact with the drum 34 and rolls over the warp ends 52 and 53 passing from the warp shed. The wheel 211 serves the dual purpose of assisting in the horizontal positioning of the weft carrier or shuttle assembly between drum 34 and rollers 38 as it passes around the circular path of the loom and of forming a path for the laying of the weft.

Positioned on plate 72 at any point convenient to guide weft ends to the surface of drum 34, and also to control the slack of the weft end 108 from reel 73, are upstanding pegs or guide pins 107. The number and position of the pins 107 may be varied accordingly. Further, a suitable slot 88*b* is provided in pointed plate 88 (see FIG. 9) to allow the adjustable supports for the guiding assembly, such as 92*a*, 101 and 212, to be attached to plate 72 as shown in FIGS. 3, 4, 22 and 26, and to allow passage of the weft end 108 from the weft supply 73 to the fabric forming plane at drum 34.

Mechanism for Orienting Warp Ends

While the weft carrier or shuttle assembly of this invention carries its own warp shed forming means, as embodied in the pointed members 88 and 91, the warp ends 52 and 53 entering the loom must be selectively oriented prior to each passage therethrough of pointed members 88 and 91 so that the weft 108 will be laid among the warp ends to form a desired pattern in the resulting fabric. In the case of a plain weave, the entering warp ends 52 and 53 must be oriented alternately upwardly and downwardly for each pass of the shuttle assembly so that on one pass, every other entering warp end forms the roof of the warp shed, while the remaining warp ends form the floor of the warp shed, and on subsequent passes, the positions of the warp ends are reversed.

Figure 19:
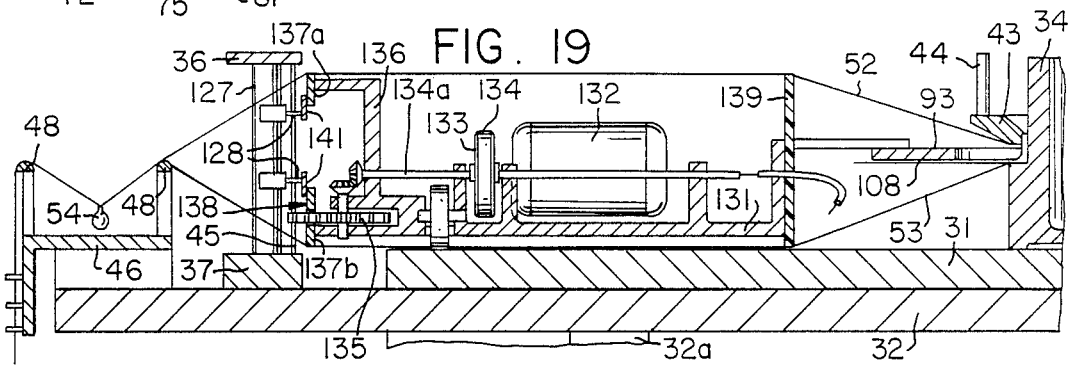
FIG. 19 is a side elevational view partly in section, similar to that of FIG. 4 but reduced in size, showing another embodiment of the invention, including alternative mechanisms for moving the shuttle assembly in its circular path and for orienting the entering warp ends.
Figure 20:
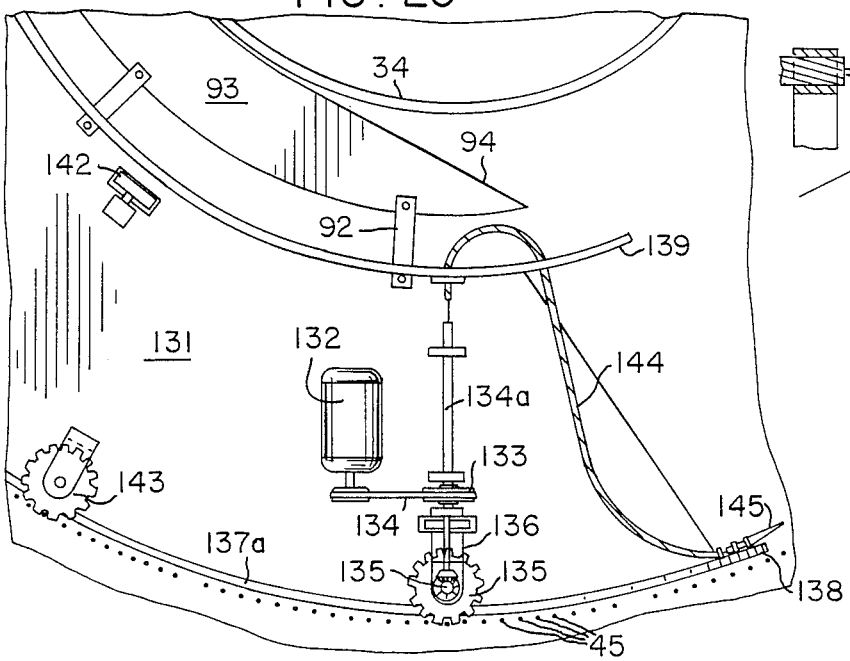
FIG. 20 is an enlarged top plan view of a portion of FIG. 19.
Figure 21:
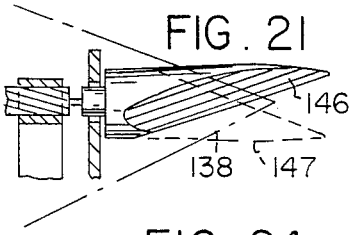
FIG. 21 is an enlarged side view partially in section of the portion of FIG. 20 embodying the alternate mechanism for orienting the entering warp ends.

FIGS. 3, 4 and 11–17 illustrate the preferred mechanism for orienting the entering warp ends 52 and 53. This embodiment is mounted on the loom supporting structure rather than being incorporated into the shuttle assembly. An alternate mechanism for orienting warp ends 52 and 53 is carried on the body member 72 of the shuttle assembly and is illustrated in FIGS. 19–21.

With reference to the preferred embodiment illustrated in FIGS. 3, 4 and 11–17, a plurality of sets of disks 111, wherein the disks in each set are mounted on a common hub 112, are each mounted for rotation of the disk set on supports 113. The supports 113 are positioned on the table of the loom, such as on the lower component 32, outside of and generally concentric with the rings 36 and 37. A set to define a ratchet 111*r* of disks 111 may comprise a single pair of disks or any number of disks which may be efficiently rotated as a set by the cam mechanism to be described. Generally speaking, the number of disks 111 in a set is determined by the width of the ribbon to be woven. Anywhere from about 4 to 32 of the disks 111, per set, have been used effectively.

Figure 17:
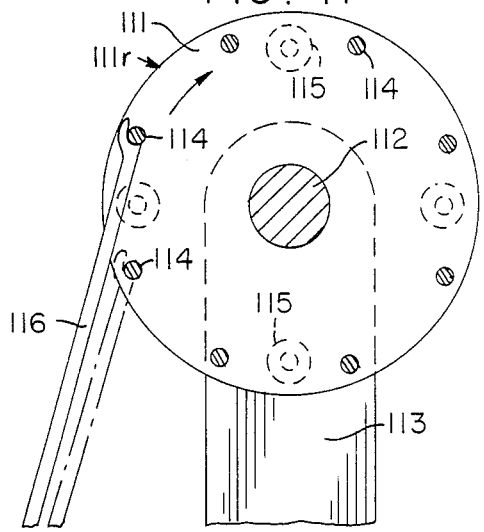
FIG. 17 is an enlarged sectional view taken along line 17—17 of FIG. 3.

As best shown in FIGS. 4 and 17, a series of drive pins 114 are mounted between any two adjacent disks 111 of each set. Conveniently, the two adjacent disks 111 at either end of the set are preferred, and the drive pins 114 are set around the perimeter of the disks. Between each other adjacent pair of disks 111 in each set is at least one warp end supporting or lifting member, such as a pin or cone 115. A ratchet bar 116, biased by spring 117, is adapted to advance each set of disks 111 by sequentially engaging pins 114. A lever arm 118, pivoted at a convenient intermediate point 119 and tensioned by spring 120, is biased by a cam follower 121 movably supported in a bearing 122 in the lower component 32 of the table of the loom. At least one of such cam followers 121 are provided for each set of disks 111. A switch 123, including a spring loaded contact 123*a*, is mounted on loom support 32*a* in connection with at least some of cam followers 121 in order to coordinate the operation of the fabric take up assembly in a timed relationship to the speed of the shuttle assembly or assemblies by actuating the solenoid 66 of the fabric take up mechanism. It has been found desirable to employ three such switches 123 about the circular path of the loom for each shuttle assembly in order to achieve three actuations of the take up mechanism for every complete rotation of one shuttle around the loom.

It will be noted that with each passage of the shuttle assembly the rising block or cam 87 mounted under the body of the shuttle assembly biases the cam follower 121, thus step wise rotating each set of disks 111. As shown in FIG. 3, it is desirable that the shuttle assembly be provided with two or more of such cams 87 so that each set of disks 111 will be advanced in at least two steps for each pass of the shuttle assembly. For this reason also, the pins 114 preferably are set at about each 45 degrees on disks 111 so that 45 degrees step wise rotation is achieved upon actuation by cam follower 121. It will be apparent that the number of pins 114 employed and the angular setting of pins 114 at various intervals will vary the extent of rotation of the disks 111 upon each pass of the shuttle assembly. Further, it will be evident that the use of a multiplicity of pins 114 and cams 87 reduces the force of impact between the cams and cam followers and reduces the noise level of the loom in operation.

In operation, as best shown in FIGS. 3, 4 and 11–16, the warp ends 52 and 53 supplied by the warp rolls 56 pass over the support rails 48 and enter the loom through the sets of disks 111 and separator or guide rods 45. Each set of disks 111 is set at an elevation, relative to the tips 88*a* and 91*a* of pointed members 88 and 91, so as to orient the entering warp ends 52 and 53 slightly above or slightly below the tips of the pointed members in advance of the shuttle assembly. Whether the individual warp ends 52 and 53 enter the loom above or below the tips 88*a* and 91*a* of the pointed members 88 and 91 depends on the relative positions of the lifting pins or cones 115 on the periphery of the disks 111. Furthermore, whether individual or sets of entering warp ends 52 and 53 alternate in up or down, for each rotational advance of a set of disks 111, depends on the number of lifting pins 115 between the disks as well as upon the relative positions of the lifting pins in any one set of disks.

For example, with reference to FIGS. 11–13, a plain weave can be achieved by providing only two lifting pins 115 which are 180 degrees apart between each adjacent pair of disks 111 in any set and arranging the pairs of pins between any two adjacent pairs of disks to be 90 degrees out of phase. With reference to FIG. 13, it will be noted that the lifting pins 115 on the foreground disk 111 are 180 degrees apart on the periphery of the disk. The pins 115 in the background disk 111 (shown in outline) although also displaced 180 degrees apart on the periphery of the disk, are 90 degrees out of phase from the pins on the foreground disk. Accordingly, the warp end 52 as it enters the loom from left to right is lifted above the center point (hub 112) of the disk 111, whereas the neighboring warp end 53 rides the hub 112 at a lower height. In consequence, warp end 52 is oriented relative to warp end 53 such that the tips 88*a* and 91*a* of pointed members 88 and 91 pass between warp ends 52 and 53 and thus separate warp ends 52 and 53 in forming a warp shed.

The entering warp ends 52 and 53 alternate in orientation between each pair of adjacent disks 111 around the periphery of the loom. After the tips 88*a* and 91*a* of pointed members 88 and 91 have traveled between any adjacent warp ends 52 and 53 to begin to form the warp shed, the orientation of the adjacent warp ends is promptly reversed by rotation of the disks 111. Such rotation of the disks 111 is caused by the cam 87 mounted on the weft carrier or shuttle assembly actuating the ratchet bar 116 through cam follower 121 and lever arm 118. Accordingly, it will be seen that, by this arrangement of components between the weft carrier and warp end orienting mechanism, the reversal of the orientation of the warp ends 52 and 53 is initiated even before the carrier or shuttle passes totally past the warp ends forming the warp shed so that the warp ends can be oriented in preparation for the next pass of a shuttle. Such an arrangement thus greatly increases the permissible speed of the shuttle assembly and allows for the operation of multiple shuttle assemblies on the same loom because the entering warp ends 52 and 53 are essentially reoriented for the next pass of a shuttle assembly before the shuttle assembly then forming the warp shed for those particular warp ends has actually completed its pass.

FIG. 11 illustrates the resulting plain weave, wherein each column of squares represents six warp ends A to F supplied by an exemplary set of disks 111. The orientation of each of the six warp ends A to F is controlled by the positions of pins 115 between the six pairs of disks 111 shown in FIG. 12. The entering warp ends A to F are therefore oriented in the sequence: up, down, up, down, up, down. The dark squares in FIG. 11 represent exposed warp ends and the unshaded squares represent weft laid across the warp ends. On the first pass or "pick" ($P_1$) of the shuttle, the $P_1$ pattern results. On each subsequent pass ($P_2$–$P_6$) the immediately preceding pattern is reversed, thus giving the checkerboard effect.

FIGS. 14–16 and 25 illustrate how a herringbone weave may be obtained. With reference to FIG. 14, the dark squares represent exposed warp ends and the unshaded squares represent weft laid across the warp ends. Between each pair of adjacent disks 111 in FIG. 15 is a center hub 112 and a single lifting pin 115. The lifting pins 115 are positioned relative to one another in FIG. 15 so that the entering warp ends 52 and 53 are positioned in the sequence: up, down, down, down, down, down. The result is that of the first row of six warp ends A to F entering the loom, only the first warp end A is elevated, with weft being laid under warp end A and above warp ends B–F. But upon the shuttle assembly entering and forming the warp shed initiated by these first six warp ends A to F, each set of disks 111 is advanced a predetermined number of degrees, for example 90 degrees in two steps of 45 degrees each, causing the lifting pins 115 to advance to the next position in preparation for the next pass of a shuttle assembly, or "pick" ($P_2$). Thus, on the next pass of a shuttle assembly, warp ends A to F will be in the positions: down, up, down, down, down, up, wherein warp ends A, B and F have changed positions, with warp ends C, D and E remaining unchanged so that the weft again is laid above these warp ends. On the third pass, or pick ($P_3$), the disks 111 will have advanced another 90 degrees to give the following sequence of warp end positions: down, down, up, down, up, down, with warp ends A and D remaining unchanged. In pick 4 ($P_4$), the relative positions are: down, down, down, up, down, down, with warp ends A, B and F remaining unchanged. In pick 5 ($P_5$), the relative positions repeat and are: up, down, down, down, down, down, and in pick 6 ($P_6$), the relative positions are: down, up, down, down, down, up. It will be noted that upon completion of pick 4 the unit herringbone pattern is completed and pick 5 begins a repetition of the pattern.

FIGS. 12 and 15 illustrate, by side views, the relative positions of the lifting pins 115 and the entering warp ends 52 and 53 during the first pick of each of the patterns illustrated by FIGS. 11 and 14. It will be apparent from the foregoing two examples that orientation (elevation) of the entering warp ends 52 and 53 depend upon the number of lifting pins 115 between any adjacent disks 111, the relative positions of the lifting pins on the periphery of each disk and between any adjacent disks, and the extent of advancement of the disks upon each pass of a shuttle assembly. It is thus evident that by suitable variation of these controls a wide variety of fabric patterns may be obtained. As such, by suitable placement and number of lifting pins 115 and relative arrangement of the sets of disks 111, other weaving patterns, such as twill, double twill, basket and sateen, may be easily woven.

Drive Means for Fabric-shaping Member

While it is preferred in the operation of the loom of this invention that the drum 34 remain stationary during the weaving of ribbon-shaped materials, it is thought that under some circumstances a step wise or continuous rotation to drum 34 in a direction opposite to that of the weft carrier or carriers might have beneficial results in overcoming a slight twist or other deformation imparted to the fabric as it is woven. Accordingly, as best shown in FIGS. 3 and 4, the fabric forming member of the loom, such as a drum 34, may be rotated in a direction opposite to the rotation of the weft carrier or shuttle assembly. Rotation of the drum 34 is conveniently accomplished through a ratchet or sprocket wheel 124 mounted on the central shaft 33, a ratchet arm 125 and a solenoid 126. The solenoid 126 may be actuated by operation of switch 123, thereby causing rotation of drum 34 in timed relationship to the passage of the shuttle assembly, since the switch is actuated by operation of the lever arm 118 and cam mechanism 87 associated with a shuttle assembly of the invention.

Alternate Mechanisms for Orienting Warp Ends and for Driving Weft Carrier

FIGS. 19–21 show alternate mechanisms for orienting warp ends 52 and 53 and for driving the weft carrier or shuttle assembly. This alternate warp ends orienting mechanism is incorporated into the weft carrier itself instead of being mounted on the loom outside of the carrier as is the case with the disk mechanism described above. With reference to FIGS. 19–21, rings 36 and 37 are spaced apart by support posts 127, which are appropriately spaced around the periphery of the circular path followed by the shuttle. Mounted on support posts 127 are a pair of brushes 128 connected to a suitable electric power supply (not shown). The body member 131 of the shuttle assembly supports an electric motor 132 in a suitable cutout, a pulley 133 engaging a belt 134 to the motor, and a shaft **134*a*. At one end of the shaft 134*a*, a sprocket wheel 135 is actuated through suitable gearing 135*a*. The sprocket wheel 135 engages the guide rod 45 mounted on the periphery of the table 30** of the loom and thereby drives the shuttle assembly around the table of the loom.

An outer portion of the body member 72 of the shuttle assembly comprises a U-shaped support member 136, the arms of which support an upper segment **137*a* and a lower segment 137*b* of an electrically insulated pointed member 138 similar in shape and function to pointed member 91. Similarly, a pointed member 139 is shaped and functions in the same fashion as previously described member 88. Each segment 137*a* and 137*b* carries a slip ring segment 141 for electrical contact with brushes 128 as the shuttle assembly traces a circular path about the loom. The support posts 127 carrying brushes 128 are positioned about the periphery of the loom such that the slip ring segments 141 are in electrical contact with at least one pair of brushes 128 at any point in the line of travel of the shuttle assembly. Electrical energy is carried to the motor 132 in the same manner and by similar connections as are described above for motor 75 and illustrated in FIG. 26. The shuttle assembly also carries one or more idler wheels such as wheel 142 in a cutout and an idler sprocket wheel 143**.

The other end of the shaft **134*a* drives a wire cable 144 and warp end orienting means comprising a finger-like member 145 having a rotating slanted face 146 and a resulting off-center point. The pointed member of "picker finger" 145 is positioned on the body member 131 such that the point is slightly in advance of the tips of pointed members 138 and 139. Thus, when the picker finger 145 has its face 146 in the upward position shown in FIG. 21, an entering warp end 52 or 53 will be displaced below the slanted face, but when the slanted face is in the position 147 shown in outline in FIG. 21, an entering warp end will be displaced upwardly of the finger. The rotation of the finger 145 is timed to displace one or more of the entering warp ends 52 and 53** in upward or downward positions and thereby to orient the warp ends in advance of the tips of pointed members 138 and 139, which then further separate the warp ends to form a warp shed through which the shuttle assembly passes.

A plain weave is provided by causing the tip of the picker finger 145 to alternate in upward and downward positions relative to alternate warp ends 52 and 53. Other fabric patterns are achieved by suitably positioning the entering warp ends 52 and 53 so as to prevent the picker finger 145 from orienting those warp ends which it is desired to maintain at higher or lower positions, or by suitable gearing of the picker finger to provide the degree of rotation required to orient any of the warp ends in the required positions. For example, the picker finger 145 may be geared such that it rotates only once per selected number of warp ends 52 and 53 in a single pass of the shuttle assembly. In this manner, patterns similar to those achieved with the sets of disks 111 described above may be obtained.

It will be evident that the circumference of the tubular fabric formed by the loom of the invention, or the width of fabric formed from tubular fabric which has been sliced vertically at one or more edges, depends upon a number of factors, such as the diameter of the table 30 upon which the shuttle assembly travels, the number of warp ends 52 and 53 entering the loom, the number of shuttle assemblies, and the number of weft ends 108 supplied by each shuttle (each shuttle may carry a plurality of weft spools or reels, if desired). Moreover, the speed of the shuttle assembly will be limited only by the speed with which the warp sheds can be formed and reformed, and the centrifugal forces exerted by the shuttle assembly as a result of its speed of travel.

Figure 18:
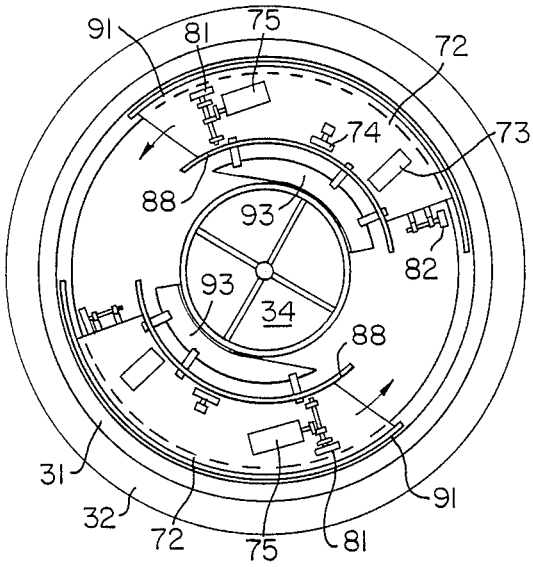
FIG. 18 is a top plan view of a modified form of the circular loom of the instant invention showing two shuttle assemblies operating simultaneously.

To some extent in high speed operation, the centrifugal force exerted by the shuttle assembly can be reduced by a balanced shuttle arrangement, such as depicted in FIG. 18. It is an important aspect of the present invention that multiple weft carriers or shuttle assemblies can be operated simultaneously due to the warp end orienting mechanisms of this invention. While electric motors are preferred as the means for driving the shuttle assembly, hydraulic motors and mechanical-type drive means may also be employed.

The loom of the invention is especially adapted for the weaving of fabric from ribbon-shaped or multi strand warp and/or weft thread. For example, fabric for heavy-duty packaging or upholstering must be heavy duty but nevertheless must breathe. Among the uses of such fabric are automobile seat covers and sandbags designed for dike construction. For these and other uses, the fabric of the invention is a high-quality product having improved surface appearance, hand and strength.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A shuttle assembly for advancing a flat ribbon-shaped weft to a fabric-making plane, said shuttle assembly being adapted for travel about a circular track on the table of a loom, which loom includes means for orienting warp ends entering the loom, said shuttle assembly comprising:

a body member, a supply of said flat ribbon-shaped weft carried by said body member, guiding means for positioning said flat ribbon-shaped weft uniformly in said fabric-making plane, whereby said weft is interwoven with said oriented warp ends to form a tubular fabric as said shuttle assembly travels about said table through said warp shed, said weft guiding means comprising a ring-shaped guide member having a curved inner side which conforms circumferentially, at least in part, to the tubular fabric, said ring-shaped guide member also having a second side, and said weft guiding means also including means for guiding said flat ribbon-shaped weft so that the weft initially engages the second side of said guide member with a plane of the weft disposed substantially parallel to the circular track, and then turns about the curved inner side of said guide member into circumferentially extending direct engagement with and between the curved inner side of said guide member and said oriented warp ends without twist, and means for actuating said warp end orienting means to complete reorienting of the warp ends, to prepare said warp ends for a next pass of a shuttle assembly.

2. A shuttle assembly adapted for circular movement about the table of a loom comprising:

a body member;

a weft supply carried by said body member;

a motive power means connected to said body member; and orienting means on said shuttle assembly for orienting entering warp ends, said orienting means being adapted to selectively direct said entering warp ends into first and second alternating positions to thereby form a warp shed, and said orienting means comprising a member having a rotating off-center point, the rotation of which is timed to orient the entering warp ends into the alternating first and second positions, said motive power means including a motor and said shuttle assembly including means for rotatably connecting said orienting means to said motor of said motive power means.

3. In combination with a circular loom having means to orient warp ends entering the loom, at least one shuttle assembly rotatable about a circular track on said loom and carrying its own supply of flat ribbon-shaped weft, means mounted on said shuttle assembly for directing said first ribbon-shaped weft uniformly toward the fabric-making plane of the loom, weft positioning means comprising a generally ring-shaped guide member having a curved inner side which conforms circumferentially, at least in part, to the tubular fabric, said ring-shaped guide member also having a second side, and said weft positioning means also including means for guiding said flat ribbon-shaped weft so that the weft initially engages the second side of said ring-shaped guide member with a plane of the weft disposed substantially parallel to the circular track, and then turns about the curved inner side or said ring-shaped guide member into circumferentially extending direct engagement with and between the curved inner side of said ring-shaped guide member and said oriented warp ends without twist, and warp guiding means mounted on said loom for positioning said oriented warp ends uniformly in the fabric-making plane of the loom.

4. The combination of claim 3 wherein the ribbon-shaped weft comprises a side-by-side array of generally cylindrical threads.

5. Apparatus according to claim 3 wherein the fabric-making plane of said loom is cylindrical in configuration, and further wherein said warp guiding means includes a guide ring spaced around the cylindrical fabric-making plane of the loom, said guide ring serving to guide the warp from said warp shed into said fabric-making plane.

6. Mechanism for orienting warp ends entering a circular loom, said loom including a table and a shuttle assembly adapted for circular travel about said table and said shuttle assembly having a body member, said mechanism comprising:

a plurality of sets of disks mounted about the periphery of said table, wherein the disks in each set are adapted to rotate together on a common axis in spaced apart relationship so as to receive warp ends therebetween, and wherein at least one pair of disks in each set has at least one warp end supporting member bridging the peripheries of said pair of disks; and means for stepwise rotation of each of said sets of disks in response to movement of said shuttle assembly past each said set of disks such that said warp ends are selectively repositioned in a first direction or a second opposite direction in preparation for a subsequent pass of said shuttle assembly.

7. Mechanism as in claim 6 including a cam surface mounted adjacent the body member of said shuttle assembly, said stepwise rotation means including a ratchet wheel adapted to rotate each said set of disks and a ratchet arm actuated by a lever bar, said lever bar being actuated by a cam follower mounted on said table of said circular loom, said cam follower being actuated by said cam surface as said shuttle assembly passes said set of disks.

8. Mechanism as in claim 7 wherein said ratchet wheel is adapted for 90 degrees rotation for each pass of said shuttle assembly.

9. Mechanism as in claim 7 wherein said shuttle assembly includes a pair of said cam surfaces mounted one adjacent each end of said body member, and wherein said ratchet wheel is adapted for 45 degree rotation for each actuation by each said cam surface.

10. Mechanism as in claim 6, wherein said warp end supporting members slope so as to impart a corresponding slope to said entering warp ends.

11. Mechanism as in claim 10 wherein said warp end supporting members are cone-shaped.

12. A circular loom for weaving tubular fabric, which comprises:

a supporting structure forming a cylindrical fabric-making plane;

means for orienting warp ends entering the loom from multiple warp supplies;

warp guiding means for positioning warp ends substantially parallel to and uniformly in said fabric-making plane;

a shuttle assembly adapted for travel about a circular track on said supporting structure, said shuttle assembly carrying a supply of flat ribbon-shaped weft; and weft guiding means for positioning the flat ribbon-shaped weft substantially parallel to and uniformly in said fabric-making plane, whereby the weft from said weft supply is interwoven with warp from said warp supplies to form a tubular fabric as said shuttle assembly travels about said track, said weft guiding means comprising a ring-shaped guide member having a curved inner side which conforms circumferentially, at least in part, to the tubular fabric, said ring-shaped guide member also having a second side, and said weft guiding means also including means for guiding said flat ribbon-shaped weft so that the weft initially engages the second side of said guide member with a plane of the weft disposed substantially parallel to the circular track, and then turns about said curved inner side of said guide member into circumferentially extending direct engagement with and between said curved inner edge of said guide member and said oriented warp ends without twist.

13. A circular loom according to claim 12 wherein said warp guiding means includes a guide ring positioned around said cylindrical fabric-making plane in such a way that said guide ring is spaced a small distance from said fabric-making plane in any radial cross section thereof.

14. A circular loom according to claim 13 wherein each radial cross section of said guide ring defines an acute angle with two legs, one leg of which is vertically positioned and generally parallel to the corresponding radial cross section of the cylindrical fabric making plane, and the other leg of which is generally parallel to the plane in which at least a portion of the warp converges to said fabric making plane.

15. A circular loom according to claim 13 wherein a portion of the warp ends define with said fabric making plane an acute angle as they converge on said fabric making plane; wherein said guide ring in each radial cross section defines a similar acute angle; and further wherein at least a portion of said warp ends pass under tension around said guide ring as they are woven into fabric in said fabric making plane.

16. A circular loom for weaving ribbon-shaped thread which comprises:

a supporting structure including a table;

a warp supply of ribbon-shaped thread;

a means for orienting warp ends from said warp supply entering the loom; and a shuttle assembly adapted for travel about a circular track on said supporting structure which carries its own supply of ribbon-shaped thread;

whereby weft from said weft supply is interwoven with warp from said warp supply to form a tubular fabric of ribbon-shaped thread as said shuttle assembly travels about said table; said apparatus further characterized in that said means for orienting warp ends entering said loom comprises:

a plurality of sets of disks mounted about the periphery of said table, wherein the disks in each set are adapted to rotate together on a common axis in spaced apart relationship so as to receive warp ends therebetween, and wherein at least one pair of disks in each set has at least one warp end supporting member bridging the peripheries of said pair of disks; and means for stepwise rotation of each of said sets of disks in response to movement of said shuttle assembly past each said set of disks such that said warp ends are selectively repositioned in a first direction or a second opposite direction in preparation for a subsequent pass of said shuttle assembly.

17. A circular loom as in claim 16 wherein said shuttle assembly includes a body member and a cam surface mounted adjacent the body member of said shuttle assembly, said stepwise rotation means including a ratchet wheel adapted to rotate each said set of disks and a ratchet bar actuated by a lever arm, said lever arm being actuated by a cam follower mounted on said table, said cam follower being actuated by said cam surface as said shuttle assembly passes said set of disks.

18. A circular loom as in claim 17 wherein said ratchet wheel is adapted for 90 degrees rotation for each pass of said shuttle assembly.

19. A circular loom as in claim 17 wherein said shuttle assembly includes a pair of said cam surfaces, and wherein said ratchet wheel is adapted for 45 degrees rotation for each actuation by each said cam surface.

20. A circular loom as in claim 16, further including means for taking up fabric as it is formed, said take-up means being actuated in timed relationship to rotation of said sets of disks, and rollers mounted about the periphery of said table for guiding said shuttle assembly about said table.

21. A circular loom as in claim 16 wherein said ribbon-shaped thread comprises a side-by-side array of generally cylindrical threads.

22. A circular loom for weaving tubular fabric, comprising:

(a) a table;

(b) warp guiding means for positioning warp parallel to and in a fabric-making plane;

(c) a warp supply;

(d) means mounted on the periphery of said table for spacing entering warp ends;

(e) a shuttle assembly adapted for circular travel about a circular track on said table, said shuttle assembly carrying its own weft supply of flat ribbon-shaped weft;

(f) warp end orienting means for forming a warp shed;

(g) weft guiding means for guiding weft from said weft supply into weaving contact with said warp ends, said guiding means being adapted to position weft uniformly in the fabric-making plane of the loom, and said weft guiding means including a ring-shaped guide member having a curved inner side conforming, at least in part, to the tubular fabric, said ring-shaped guide member also having a second side, and said weft guiding means also including means for guiding said flat ribbon-shaped weft so that the weft initially engages the second side of said guide member with a plane of the weft disposed substantially parallel to said circular track for said shuttle, and then turns about said inner side into circumferentially extending direct engagement with and between the curved inner side of said guide member and said oriented warp ends in the fabric plane without twist; and (h) means actuated in timed relationship to each pass of said shuttle assembly for taking up fabric as it is formed.

23. A circular loom according to claim 22 wherein said warp guiding means includes a guide ring positioned around said cylindrical fabric-making plane, said guide ring being spaced a small distance from said cylindrical fabric-making plane in each radial cross section thereof so that said guide ring serves to guide the warp ends as they converge into the fabric making-plane of the loom so that twisting of the warp ends in the fabric-making plane is prevented.

24. A circular loom according to claim 23 wherein each radial cross section of said guide ring defines an acute angle, having two legs, one leg of which is vertically positioned and generally parallel to the corresponding radial cross section of the cylindrical fabric-shaping member, the other leg of which is generally parallel to the plane in which at least a portion of the warp converges to said fabric making plane.

25. A circular loom according to claim 23 wherein a portion of warp ends of said warp shed define with said fabric making plane an acute angle as they converge on said fabric making plane; wherein said guide ring in each radial cross section defines a similar acute angle; and further wherein at least a portion of said warp ends pass under tension around said guide ring as they are woven into fabric in said fabric making plane.

26. A circular loom as in claim 22 wherein said ribbon-shaped weft comprises a side-by-side array of generally cylindrical threads.

27. A circular loom comprising:

(a) a table;

(b) a warp supply;

(c) means mounted on the periphery of said table for spacing entering warp ends;

(d) a shuttle assembly adapted for circular travel about said table, said shuttle assembly comprising:

a body member, said body member carrying a weft supply;

means for guiding weft to contact with warp in said fabric forming plane; and a cam surface mounted on said body member;

(e) a mechanism for orienting warp ends entering said loom comprising:

a plurality of sets of disks mounted on the periphery of said table, wherein the disks in each set are adapted to rotate together on a common axis in spaced apart relationship so as to receive warp ends therebetween, and wherein at least one pair of disks in each set has at least one warp end supporting member bridging the peripheries of said pair of disks; and means for stepwise rotation of each of said sets of disks in response to movement of said shuttle assembly past each said set of disks such that said warp ends are selectively repositioned upwardly or downwardly in preparation for a subsequent pass of said shuttle assembly, said stepwise rotation means including a ratchet wheel adapted to rotate each said set of disks and a ratchet bar actuated by a lever arm, said lever arm being actuated by a cam follower mounted on a table of said circular loom, said cam follower being actuated by said cam surface as said shuttle assembly passes said set of disks; and (f) means for taking up fabric as it is formed, said take-up means being actuated in timed relationship to rotation of said sets of disks.

28. A circular loom as in claim 27 including an electric switch actuated by said lever arm of said stepwise rotation means, to thereby actuate said fabric-shaping member (b) and said fabric take-up means (g) in timed relationship to passage of said shuttle assembly.

29. A circular loom as in claim 27 wherein said ratchet wheel is adapted for 90 degrees rotation for each pass of said shuttle assembly.

30. A circular loom as in claim 27 wherein said shuttle assembly includes a pair of said cam surfaces, and wherein said ratchet wheel is adapted for 45 degrees rotation for each actuation by each said cam surface.

31. A circular loom for weaving ribbon-shaped thread which comprises: a supporting structure; a shuttle assembly adapted for travel about a circular track on said supporting structure; a weft supply of ribbon-shaped thread carried by said shuttle assembly; orienting means on said shuttle assembly for orienting warp ends in advance of said shuttle assembly; an electric motor mounted on said shuttle assembly; means for rotatably connecting said warp end orienting means to said motor; and warp shed forming means connected to said shuttle assembly to form said oriented warp ends into a warp shed through which the shuttle assembly travels to form the tubular fabric.

32. A circular loom according to claim 31 wherein said orienting means comprises a member having a rotating off-center point, the rotation of which is timed to provide warp sheds wherein the entering warp ends alternate in upper and lower positions after each pass of said shuttle assembly.

33. A method of weaving tubular fabric having improved pattern regularity and surface characteristics, which comprises:

(a) orienting warp ends entering a circular loom about the periphery of a table of the loom, into a preselected offset relationship in accordance with a desired weaving pattern;

(b) passing at least one shuttle assembly carrying a supply of flat ribbon-shaped weft in a circular path about the table of the loom through the oriented warp ends entering said loom;

(c) forming a warp shed for the passage of said shuttle assembly there-through;

(d) guiding said oriented warp ends under tension from said warp shed so that they converge on a fabric-making plane of the loom and are laid evenly and uniformly into said fabric-making plane;

(e) laying the flat ribbon-shaped weft from said weft supply uniformly and evenly in the fabric-making plane of the loom between said oriented warp ends as said warp ends converge into said fabric-making plane, to form said tubular fabric;

(f) engaging said tubular fabric, as it is formed, with a ring-shaped guide member having a curved inner side which conforms circumferentially, at least in part, to the tubular fabric;

(g) passing said flat ribbon-shaped weft into engagement with a second side of said ring-shaped guide member with a plane of the weft disposed substantially parallel to the circular path of the shuttle assembly, and then turning said flat ribbon-shaped weft about and into circumferentially extending direct engagement with and between the curved inner side of said ring-shaped guide member and said oriented warp ends without twist; and (h) taking up said tubular fabric as it is formed.

34. A fabric produced by the method of claim 33.

35. A method of weaving a tubular fabric which comprises:

(a) positioning horizontally-oriented entering warp ends in a desired vertical spaced relationship with respect to one another;

(b) simultaneously (i) forming a warp shed, (ii) changing the orientation of the warp ends from generally horizontal to vertical as they converge on the vertical fabric forming plane of the loom, and (iii) laying flat weft ribbon from a weft supply carried by said shuttle assembly between said oriented warp ends as said warp ends converge from said warp shed into said vertical fabric forming plane;

(c) engaging said tubular fabric, as it is formed, with a horizontally disposed, ring-shaped weft guide means having a curved inner side which conforms circumferentially, at least in part, to the tubular fabric, said guide means also having a second side;

(d) passing said flat ribbon-shaped weft into engagement with a second side of said guide means with a plane of the weft horizontally disposed, and then turning said flat ribbon-shaped weft about and into circumferentially extending direct engagement with and between the curved inner side of said horizontally disposed guide means and said oriented warp ends without twist; and (e) taking up said tubular fabric as it is formed.

36. The method of claim 35, wherein said flat weft ribbon is formed in a ribbon shape by arranging a plurality of substantially cylindrical threads in a side-by-side array.

37. The method according to claim 35, wherein changing the orientation of the warp ends from generally horizontal to vertical as they converge on the vertical fabric forming plane and holding the fabric as it is formed in said fabric forming plane are accomplished by passing the warp ends into said fabric forming plane about an inner edge of a single guide member.

38. The method according to claim 37, wherein at least a portion of the warp ends are passed under tension around said warp guide member so that said portion of the warp ends are subjected to positive guiding when they move from said warp shed, when they reorient themselves from generally horizontally oriented to vertically oriented, and when they converge on the vertical fabric forming plane and are laid evenly and uniformly in said fabric forming plane.

39. A fabric produced by the method of claim 35.

40. A shuttle assembly for advancing a flat strip-like weft to a fabric-making plane, said shuttle assembly being adapted for circular movement about the table of a loom, which loom includes means for orienting warp ends entering the loom, said shuttle assembly comprising:

a body member, a weft supply carried by said body member, and guiding means for positioning said flat strip-like weft uniformly in said fabric-making plane, whereby weft is interwoven with warp to form a tubular fabric as said shuttle assembly travels about said table through said warp shed, said guiding means comprising an idler wheel having a rim for guiding the weft to the fabric-making plane, said idler wheel having a plurality of parallel channels on the rim thereof for receiving a plurality of weft ends and for guiding the weft ends to the fabric forming plane.

41. A shuttle assembly for advancing a weft to a fabric-making plane, said shuttle assembly being adapted for circular movement about the table of a loom, which loom includes means for orienting warp ends entering the loom, said shuttle assembly comprising:

a body member, a weft supply carried by said body member, motive power means forming means connected to said body member for forming a warp shed from said oriented warp ends, and guiding means for positioning said weft uniformly in said fabric-making plane, whereby weft is interwoven with warp to form a tubular fabric as said shuttle assembly travels about said table through said warp shed, said forming means comprising at least one pointed member, and said shuttle assembly including means for orienting entering warp ends mounted in advance of said pointed member, and means for rotatably connecting said orienting means to said motive power means, said orienting means being adapted to selectively direct said entering warp ends over and under the point of said pointed member to thereby form a warp shed.

42. A shuttle assembly as in claim 41 wherein said orienting means comprises a member having a rotating off-center point, the rotation of which is timed to provide warp sheds wherein the entering warp ends alternate in upper and lower positions with each pass of said shuttle assembly.

43. In combination with a circular loom having means to orient warp ends entering the loom and having a fabric-making plane which is cylindrical in configuration, at least one shuttle assembly carrying its own weft supply, means on said loom for resetting the warp end orienting means, weft positioning means for positioning a ribbon-shaped weft uniformly in the fabric-making plane of the loom, said weft positioning means including an idler roller having a generally flat rim for guiding the ribbon-shaped weft into the fabric making-plane and having a plurality of channels on the rim, said channels being adapted to receive a plurality of generally cylindrical weft ends, said plurality of generally cylindrical weft ends together defining the ribbon-shaped weft, and warp guiding means mounted on said loom for positioning a ribbon-shaped warp uniformly in the fabric-making plane of the loom.

44. A circular loom for weaving tubular fabric, which comprises:

a supporting structure defining a cylindrical fabric-making plane;

means for orienting warp ends entering the loom from a warp supply;

warp guiding means for positioning warp substantially parallel to and uniformly in said fabric-making plane; and a shuttle assembly adapted for travel about a circular track on said supporting structure, said shuttle assembly carrying its own weft supply of thread and a motive power means, and said shuttle assembly including weft guiding means for positioning the weft substantially parallel to and uniformly in said fabric-making plane, whereby weft from said weft supply is interwoven with warp from said warp supply to form a tubular fabric as said shuttle assembly travels about said track, and said shuttle assembly further including a warp shed forming means having at least one pointed member and including means for orienting entering warp ends in advance of said pointed member, and means for rotatably connecting said orienting means to said motive power means, said orienting means being adapted to selectively direct said entering warp ends over and under a point of said pointed member.

45. A circular loom as in claim 44 wherein said orienting means comprises a member having a rotating off-center point, the rotation of which is timed to provide warp sheds wherein the entering warp ends alternate in upper and lower positions with each pass of said shuttle assembly.

46. A circular loom for weaving tubular fabric, which comprises:

a supporting structure defining a cylindrical fabric-making plane;

means for orienting warp ends entering the loom from a warp supply;

warp guiding means for positioning warp substantially parallel to and uniformly in said fabric-making plane; and a shuttle assembly adapted for travel about a circular track on said supporting structure, said shuttle assembly carrying its own weft supply of ribbon-shaped thread and including weft guiding means for positioning the ribbon-shaped weft substantially parallel to and uniformly in said fabric-making plane, whereby weft from said weft supply is interwoven with warp from said warp supply to form a tubular fabric as said shuttle assembly travels about said track, said weft guiding means including an idler wheel having a plurality of parallel channels in the rim thereof, said channels being adapted to receive a plurality of generally cylindrical threads in a side-by-side array.

47. A circular loom comprising:

(a) a table;

(b) a cylindrical fabric-shaping member positioned centrally on said table;

(c) warp guiding means for positioning warp parallel to and flat against said fabric shaping member;

(d) a warp supply;

(e) means mounted on the periphery of said table for spacing entering warp ends;

(f) a shuttle assembly adapted for circular travel about said table, said shuttle assembly carrying its own ribbon-shaped weft supply and including an electric motor and sprocket means to drive said shuttle assembly about the table, warp end orienting and warp shed forming means, and weft guiding means for guiding weft from said weft supply into weaving contact with said warp ends, said guiding means being adapted to position ribbon-shaped weft uniformly and directly against the fabric in the fabric making plane of the loom and including an idler wheel having a plurality of parallel channels in the rim thereof, said channels being adapted to receive a plurality of generally cylindrical threads in a side-by-side array;

(g) means for supplying electrical power to said electric motor; and (h) means actuated in timed relationship to each pass of said shuttle assembly for taking up fabric as it is formed.

48. A circular loom for weaving tubular fabric, which comprises:

a supporting structure forming a cylindrical fabric-making plane;

means for orienting warp ends entering the loom from a warp supply;

warp guiding means for positioning the warp ends in said fabric-making plane;

shuttle means adapted for travel about a circular track on said supporting structure, for carrying a supply of flat ribbon-shaped weft about said cylindrical fabric-making plane; and weft guiding means for positioning the flat ribbon-shaped weft parallel to and uniformly in said fabric-making plane, whereby the flat ribbon-shaped weft from said weft supply is interwoven with the warp from said warp supply to form the tubular fabric as said shuttle assembly travels about said track, said weft guiding means including a ring-shaped guide member having a curved inner side, said inner side conforming circumferentially, at least in part, to the tubular fabric, and said ring-shaped guide member also having a second side, and means for guiding said flat ribbon-shaped weft so that the weft initially engages the second side of said guide member with a plane of the weft disposed substantially parallel to said circular track for said shuttle means, and then turns about said inner side into circumferentially extending direct engagement with an between the curved inner side of said guide member and said oriented warp ends in the fabric plane without twist.

49. A circular loom as in claim 48, wherein said ring-shaped guide member is horizontally disposed and said second side is a lower side, and said flat ribbon-shaped weft engages the lower side of said guide member with a plane of said weft horizontally disposed, turns about the inner side of said guide member so that the plane of the weft is vertically disposed, and travels into circumferentially extending direct engagement with and between the curved inner side of said guide member and said warp ends into the fabric-making plane without twist.

50. A circular loom as in claim 48, wherein said ring-shaped weft guide member is adapted for sliding contact with said tubular fabric as it is formed.

51. A circular loom for weaving tubular fabric, which comprises:

means for orienting warp ends entering the loom from a warp supply;

warp guiding means for positioning the warp ends in a fabric-making plane;

shuttle means adapted for travel about a circular track on said supporting structure, for carrying a supply of flat ribbon-shaped weft about said cylindrical fabric-making plane;

weft guiding means for positioning the flat ribbon-shaped weft in said fabric-making plane, whereby the weft from said weft supply is interwoven with the warp from said warp supply to form the tubular fabric as said shuttle assembly travels about said track, said warp orienting means being responsive to the rotation of said shuttle means and selectively reorienting said warp ends entering the loom from the warp supply in preparation for a next pass of a shuttle; and said weft guiding means including a ring-shaped guide member having a curved inner side conforming circumferentially, at least in part, to the tubular fabric, said ring-shaped guide member also having a second side, and said weft guiding means also including means for guiding said flat ribbon-shaped weft so that the weft initially engages the second side of said guide member with a plane of the weft disposed substantially parallel to said circular track for said shuttle means, and then turns about said inner side into circumferentially extending direct engagement with and between the curved inner side of said guide member and said oriented warp ends in the fabric plane without twist.

52. A circular loom as in claim 51, wherein said ring-shaped guide member is horizontally disposed and said second side is a lower side, and said flat ribbon-shaped weft engages the lower side of said guide member with a plane of said weft horizontally disposed, turns about the inner side of said guide member so that the plane of the weft is vertically disposed, and travels into circumferentially extending direct engagement with and between the curved inner side of said guide member and said warp ends in the fabric-making plane without twist.

53. A method of weaving tubular fabric in a circular loom, which comprises:

(a) positioning warp ends in a desired spaced relationship to one another about the periphery of the loom;

(b) simultaneously (i) forming a warp shed (ii) changing the orientation of the warp ends as they converge on a fabric forming plane of the loom, (iii) engaging said tubular fabric, as it is formed, with a curved inner side of a ring-shaped guide member conforming circumferentially, at least in part, to the tubular fabric, (iv) guiding flat ribbon-shaped weft from a weft supply carried by said shuttle assembly into engagement with a second side of said ring-shaped guide member with a plane of the weft disposed substantially parallel to the circular track, and (v) turning the flat ribbon-shaped weft about the inner side of the ring-shaped guide member into circumferentially extending direct engagement with and between the curved inner side of said guide member and said oriented warp ends without twist as said warp ends converge from said warp shed into said fabric forming plane;

(c) selectively reorienting said entering warp ends in response to passage of said shuttle assembly, in preparation for the next pass of a shuttle assembly; and (d) taking up said tubular fabric as it is formed.

54. A fabric produced by the method of claim 53.

55. A method of weaving tubular fabric in a circular loom, which comprises:

(a) positioning warp ends in a desired spaced relationship to one another about the periphery of the loom;

(b) forming a warp shed;

(c) changing the orientation of the warp ends as they converge on a fabric forming plane of the loom so that the warp ends become disposed in the fabric forming plane;

(d) engaging said tubular fabric, as it is formed, with a ring-shaped weft guide member having a curved inner side which conforms circumferentially, at least in part, to said tubular fabric, said guide member also having a second side;

(e) laying flat ribbon-shaped weft from a weft supply carried by said shuttle assembly between said warp ends as said warp ends converge from said warp shed into said fabric forming plane, by passing said flat ribbon-shaped weft into engagement first with the second side of said guide member with a plane of the weft disposed substantially parallel to a path of travel of said shuttle assembly, and then turning said flat ribbon-shaped weft about said inner side into circumferentially extending direct engagement with and between the curved inner side of said guide member and said warp ends in the fabric-making plane without twist, to form the tubular fabric; and (f) taking up said tubular fabric as it is formed.

56. A method as in claim 55, wherein the ring-shaped weft guide member is horizontally disposed so that the second side is a lower side, and the flat ribbon-shaped weft is engaged under the lower side of the horizontally disposed guide member with a plane of the weft horizontally disposed, turned about the inner side of the guide member so that the plane of the weft is vertically disposed, and passed into circumferentially extending direct engagement with and between the curved inner side of the guide member and the warp ends without twist.

57. A fabric produced by the method of claim 55.

58. A fabric produced by the method of claim 56.

59. The method as in claim 55, which further comprises arranging the ring-shaped weft guide member for sliding contact with said tubular fabric as it is formed.

* * * * *